US011597053B2

(12) United States Patent
Huang et al.

(10) Patent No.: US 11,597,053 B2
(45) Date of Patent: Mar. 7, 2023

(54) POLISHING PAD, METHOD FOR MANUFACTURING POLISHING PAD, AND POLISHING METHOD

(71) Applicant: TAIWAN SEMICONDUCTOR MANUFACTURING COMPANY LIMITED, Hsin-Chu (TW)

(72) Inventors: Chi-Hao Huang, Zhunan Township (TW); Hsuan-Pang Liu, Hsinchu (TW); Yuan-Chun Sie, Toufen (TW); Pinyen Lin, Rochester, NY (US); Cheng-Chung Chien, Hsinchu (TW)

(73) Assignee: TAIWAN SEMICONDUCTOR MANUFACTURING CO., LTD., Hsin-Chu (TW)

( * ) Notice: Subject to any disclaimer, the term of this patent is extended or adjusted under 35 U.S.C. 154(b) by 1037 days.

(21) Appl. No.: 16/205,318

(22) Filed: Nov. 30, 2018

(65) Prior Publication Data

US 2019/0099856 A1 Apr. 4, 2019

Related U.S. Application Data

(62) Division of application No. 15/158,529, filed on May 18, 2016, now Pat. No. 10,189,143.

(60) Provisional application No. 62/261,016, filed on Nov. 30, 2015.

(51) Int. Cl.

| | |
|---|---|
| ***B24B 37/20*** | (2012.01) |
| ***B24D 18/00*** | (2006.01) |
| ***B24B 37/22*** | (2012.01) |
| ***B24B 37/26*** | (2012.01) |

(52) U.S. Cl.
CPC ..... *B24B 37/20* (2013.01); *B24B 37/22* (2013.01); *B24B 37/26* (2013.01); *B24D 18/0045* (2013.01)

(58) Field of Classification Search
CPC ..... B24B 37/20; B24B 37/205; B24B 37/22; B24B 37/24; B24B 37/245; B24B 37/26
See application file for complete search history.

(56) References Cited

U.S. PATENT DOCUMENTS 5,578,362 A * 11/1996 Reinhardt ..... B24B 53/017 428/313.5
6,036,586 A * 3/2000 Ward ..... B24B 37/14 451/550
6,331,137 B1 12/2001 Raeder et al.
7,025,668 B2 4/2006 Petroski et al.
(Continued)

FOREIGN PATENT DOCUMENTS

DE 102012018200 A1 3/2013
JP 2005294410 A 10/2005
(Continued)

OTHER PUBLICATIONS

First Examination Report from German Patent Office; Jan. 25, 2023; 7 Pages.

*Primary Examiner* — Joel D Crandall
(74) *Attorney, Agent, or Firm* — Cooper Legal Group, LLC

(57) ABSTRACT

A polishing pad for a chemical-mechanical polishing apparatus includes a first support layer and a polishing layer. The polishing layer is present on the first support layer. The polishing layer has a top surface that faces away from the first support layer and at least one first cavity that is buried at least beneath the top surface of the polishing layer.

20 Claims, 8 Drawing Sheets

(56) References Cited

U.S. PATENT DOCUMENTS

| | | | | |
|---|---|---|---|---|
| 7,300,335 | B2 | 11/2007 | Tajima et al. | |
| 7,807,252 | B2 | 10/2010 | Hendron et al. | |
| 7,867,066 | B2 | 1/2011 | Suzuki | |
| 9,108,291 | B2 | 8/2015 | Lakrout | |
| 2004/0180611 | A1 | 9/2004 | Tajima et al. | |
| 2004/0232121 | A1* | 11/2004 | Park | B23K 26/382 219/121.69 |
| 2006/0270328 | A1 | 11/2006 | Horie et al. | |
| 2006/0286350 | A1* | 12/2006 | Hendron | B24B 37/26 428/167 |
| 2007/0037486 | A1 | 2/2007 | Kang et al. | |
| 2007/0072526 | A1* | 3/2007 | Ladjias | B24B 37/22 451/533 |
| 2007/0141312 | A1 | 6/2007 | James | |
| 2007/0210491 | A1* | 9/2007 | Saikin | B29C 67/205 264/460 |
| 2008/0064302 | A1 | 3/2008 | Fujitani | |
| 2008/0064311 | A1* | 3/2008 | Suzuki | B24B 37/26 451/527 |
| 2008/0155903 | A1 | 7/2008 | Preston | |
| 2009/0093200 | A1 | 4/2009 | Iwase et al. | |
| 2010/0099340 | A1* | 4/2010 | Chen | B24B 37/16 451/287 |
| 2010/0267318 | A1 | 10/2010 | Duboust et al. | |
| 2010/0273404 | A1 | 10/2010 | Chiu et al. | |
| 2011/0011007 | A1 | 1/2011 | Feng et al. | |
| 2011/0053465 | A1 | 3/2011 | Tsai et al. | |
| 2012/0009847 | A1 | 1/2012 | Menk et al. | |
| 2013/0029566 | A1 | 1/2013 | Suzuki et al. | |
| 2013/0074419 | A1 | 3/2013 | Lakrout | |
| 2013/0283700 | A1* | 10/2013 | Bajaj | B29C 35/0805 51/295 |
| 2015/0079886 | A1* | 3/2015 | Schutte | B24B 37/26 451/527 |
| 2015/0174826 | A1 | 6/2015 | Murugesh et al. | |

FOREIGN PATENT DOCUMENTS

| | | | |
|---|---|---|---|
| JP | 2006187819 | A | 7/2006 |
| JP | 2008098356 | A | 4/2008 |
| JP | 2013027951 | A | 2/2013 |
| KR | 20050002378 | A | 1/2005 |
| TW | 201325820 | A | 7/2013 |

* cited by examiner

POLISHING PAD, METHOD FOR MANUFACTURING POLISHING PAD, AND POLISHING METHOD

PRIORITY CLAIM AND CROSS-REFERENCE

This application is a divisional of and claims priority to U.S. Non-Provisional application Ser. No. 15/158,529, titled "POLISHING PAD, METHOD FOR MANUFACTURING POLISHING PAD, AND POLISHING METHOD" and filed on May 18, 2016, which claims priority to U.S. Provisional Application Ser. No. 62/261,016, titled "INVISIBLE LAMINATION CMP PAD GROOVING" and filed on Nov. 30, 2015. U.S. Non-Provisional application Ser. No. 15/158,529 and U.S. Provisional Application Ser. No. 62/261,016 are herein incorporated by reference.

BACKGROUND

Chemical mechanical polishing/planarization (CMP) is a process of smoothing surfaces with the combination of chemical and mechanical forces. The process uses an abrasive and corrosive chemical slurry in conjunction with a polishing pad. The CMP process can remove material on a wafer and tends to even out irregular topography of the wafer, making the wafer flat or planar.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
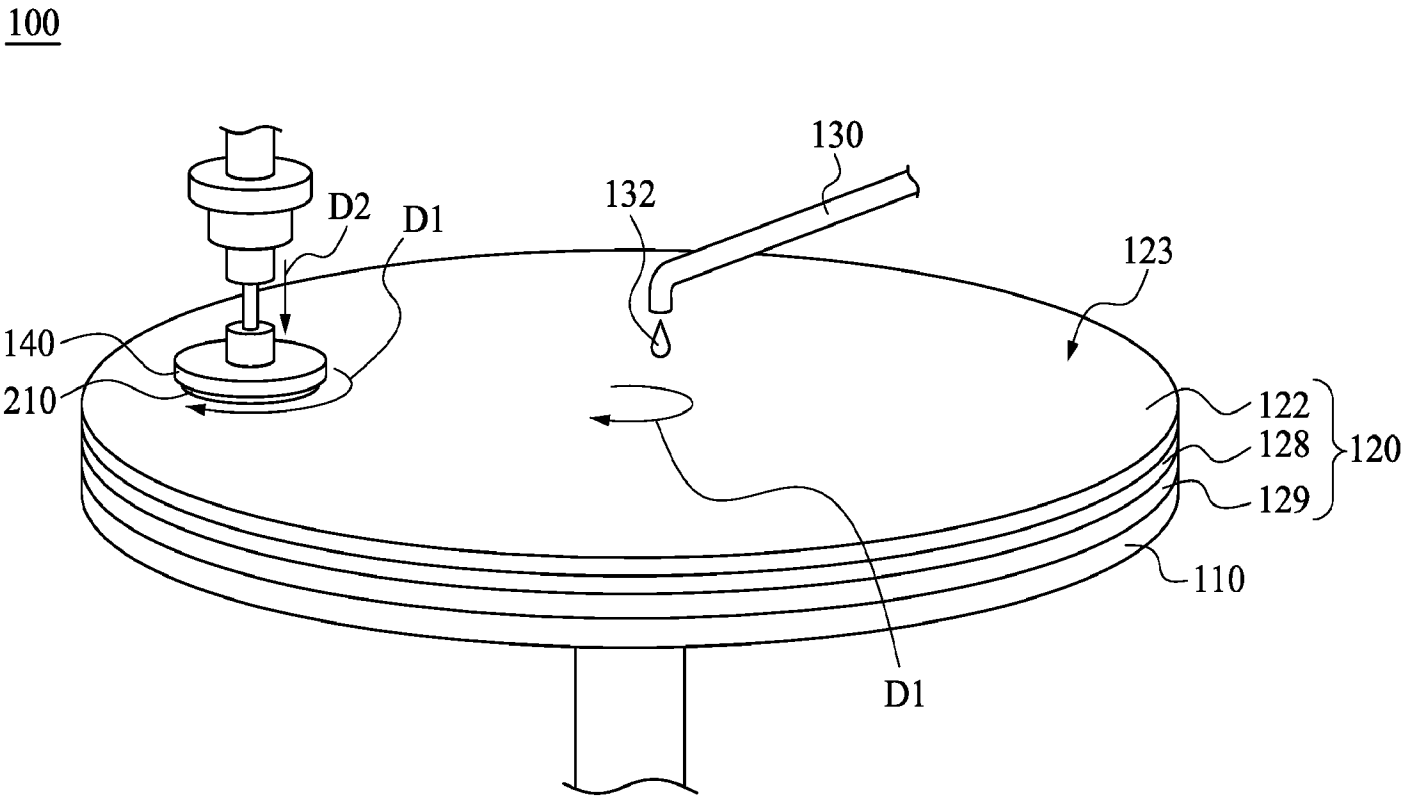
FIG. 1 is a perspective view of a chemical-mechanical polishing apparatus according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The present disclosure will be described with respect to embodiments in a specific context, a polishing layer of a polishing pad having first and second grooves respectively at different horizontal levels. The first and second grooves may be used to accommodate slurry for polishing a wafer. When the second groove in the top surface of the polishing layer exists, the slurry may flow into the second groove and may be stored by the second groove for polishing the wafer. After the second groove is worn out and disappeared, the first groove buried in the polishing layer is exposed through the top surface of the polishing layer. As a result, the slurry may flow into the first groove and may be stored by the first groove for continuously polishing the wafer. The embodiments of the disclosure may also be applied, however, to a variety of polishing pads. Various embodiments will be explained in detail with reference to the accompanying drawings.

FIG. 1 is a perspective view of a chemical-mechanical polishing apparatus 100 according to some embodiments of the present disclosure. As shown in FIG. 1, the chemical-mechanical polishing apparatus 100 includes a platen 110, a polishing pad 120, a slurry feed 130, and a carrier device 140. The polishing pad 120 is present on the platen 110 and has a polishing layer 122. The slurry feed 130 and the carrier device 140 are present above the polishing layer 122. When the chemical-mechanical polishing apparatus 100 is in operation, the slurry feed 130 may dispense slurry 132 onto the polishing layer 122, and the polishing pad 120 may be rotated in a direction D1 by the platen 110. After the slurry 132 is distributed over the polishing layer 122 of the polishing pad 120, the carrier device 140 may push a wafer 210 in a direction D2 against the polishing layer 122, such that one side of the wafer 210 in contact with the polishing layer 122 may be polished by the slurry 132. For further planarization of the wafer 210, the carrier device 140 may rotate (e.g., also in the direction D1) and move on the polishing layer 122 of the polishing pad 120 at the same time, but various embodiments of the present disclosure are not limited in this regard.

Figure 2:
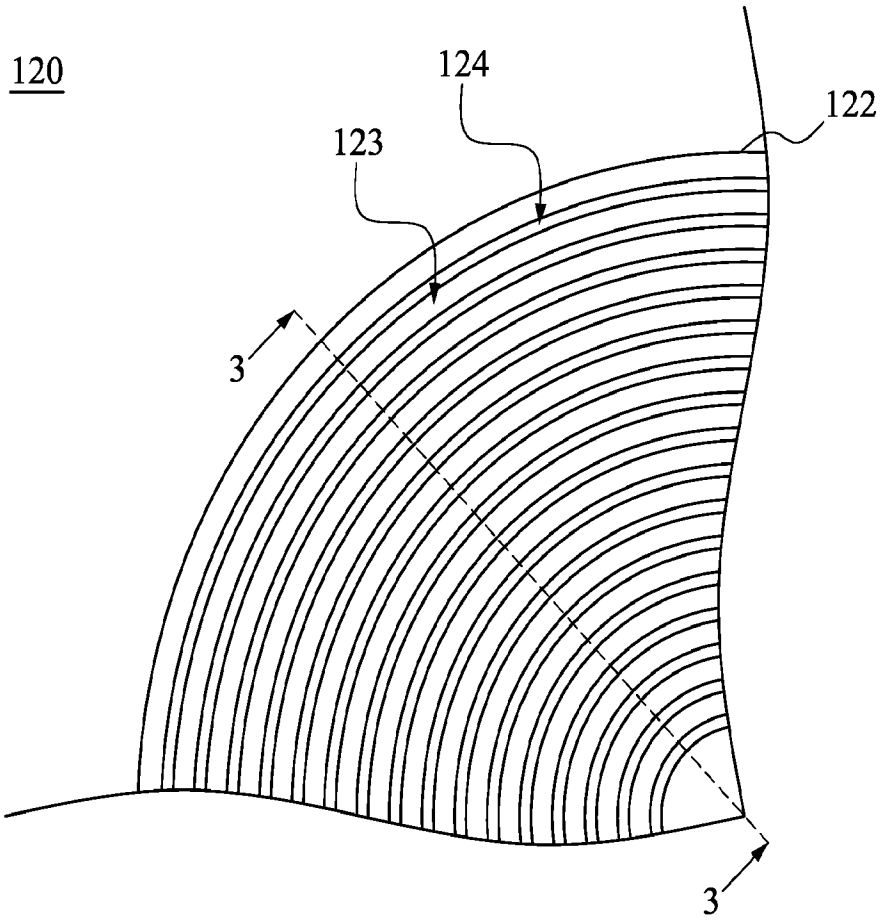
FIG. 2 is a partially enlarged view of a polishing pad of the chemical-mechanical polishing apparatus shown in FIG. 1.
Figure 3:
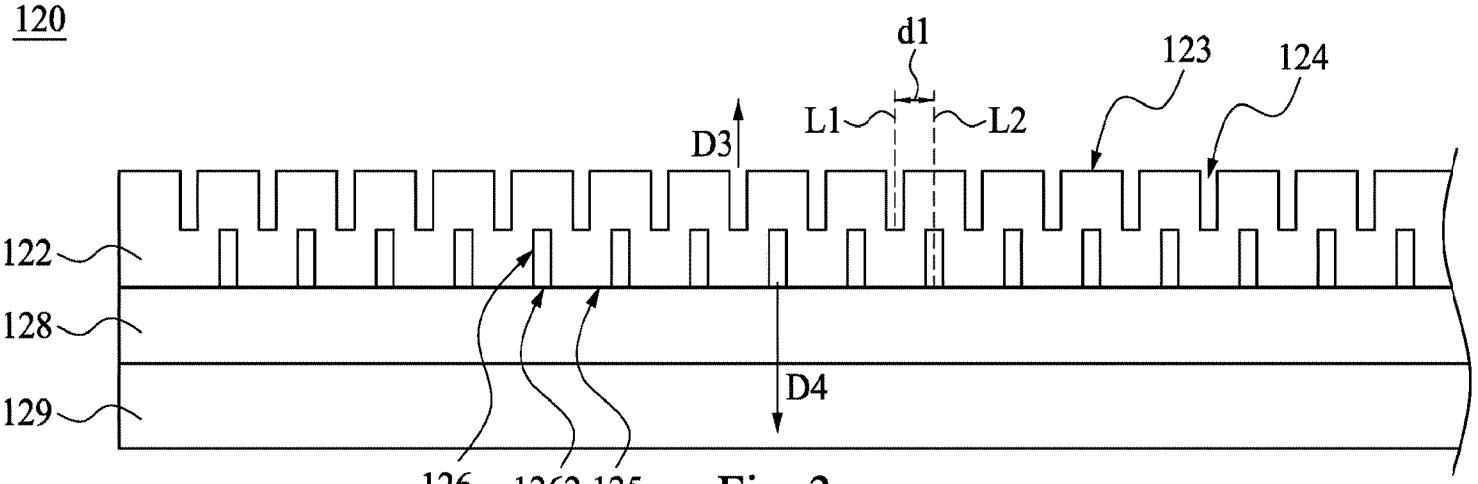
FIG. 3 is a cross-sectional view of the polishing pad taken along line 3-3 shown in FIG. 2.

FIG. 2 is a partially enlarged view of the polishing pad 120 of the chemical-mechanical polishing apparatus 100 shown in FIG. 1. FIG. 3 is a cross-sectional view of the polishing pad 120 taken along line 3-3 shown in FIG. 2. As shown in FIG. 2 and FIG. 3, the polishing pad 120 includes the polishing layer 122 and a first support layer 128. The polishing layer 122 is present on the first support layer 128. The first support layer 128 is located between the platen 110 (see FIG. 1) and the polishing layer 122. The first support layer 128 is harder than the polishing layer 122, such that the first support layer 128 may provide a supporting force to the polishing layer 122.

The polishing layer 122 is located on the first support layer 128 and has a top surface 123 and a bottom surface 125. The bottom surface 125 faces away from the top surface 122 and faces the first support layer 128. The polishing layer 122 has at least one first groove 124 and at least one second groove 126. In some embodiments, the second groove 126 may be a cavity buried at least beneath the top surface 123 of the polishing layer 122. The first groove 124 is present on the top surface 123 of the polishing layer 122. In some embodiments, the second groove 126 is a groove having an opening 1262 on the bottom surface 125 of the polishing layer 122, and the opening 1262 of the second groove 126 is covered by the first support layer 128, such that the second groove 126 can be considered a buried groove. On the other hand, the first groove 124 is an open groove in the top surface 123 of the polishing layer 122.

In other words, the top surface 123 of the polishing layer 122 has the first groove 124 therein, and the bottom surface 125 of the polishing layer 122 has the second groove 126 therein. The first and second grooves 124, 126 are respectively present at opposite sides of the polishing layer 122, and the opening direction D3 of the first groove 124 faces away from the opening direction D4 of the second groove 126. It is to be noted that the number of the first and second grooves 124, 126 of the polishing layer 122 shown in FIG. 3 is for illustration, and various embodiments of the present disclosure are not limited in this regard.

In some embodiments, the first and second grooves 124, 126 of the polishing layer 122 may be in a concentric arrangement, but various embodiments of the present disclosure are not limited in this regard.

As shown in FIG. 1 and FIG. 3, when the slurry 132 is dispensed onto the polishing layer 122 of the polishing pad 120 and the platen 110 rotates, the slurry 132 may flow on the top surface 123 of the polishing layer 122 and may flow into the first groove 124. As a result, the slurry 132 is accommodated in the first groove 124 of the polishing layer 122, and the slurry 132 and the polishing layer 122 are used to polish the wafer 210 that is in contact with the polishing layer 122. After the top surface 123 of the polishing layer 122 is ground by a number of wafers 210 for a period of time, the first groove 124 may be worn down and either reduced in size or disappear because of being ground by the slurry 132 and the wafers 210.

Figure 4:
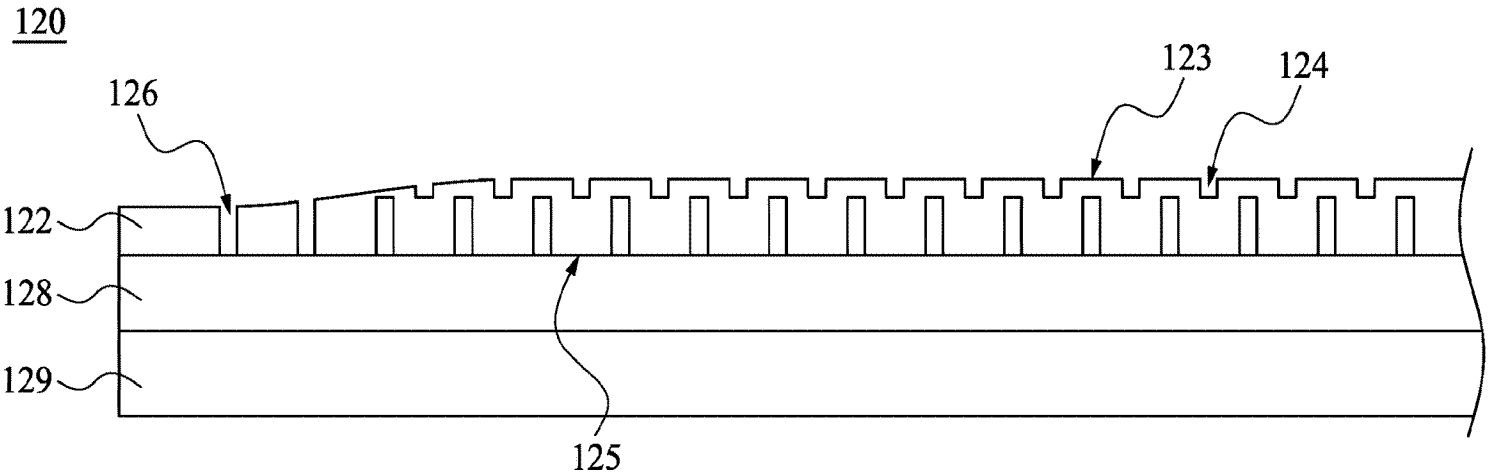
FIG. 4 is a cross-sectional view of the polishing pad shown in FIG. 3 after a first groove of the polishing pad is exposed.

As shown in FIG. 3, the first groove 124 and the second groove 126 are separated from the top surface 123 of the polishing layer 120 at different vertical distances. FIG. 4 is a cross-sectional view of the polishing pad 120 shown in FIG. 3 after the second groove 126 of the polishing pad 120 is exposed. As shown in FIG. 4, when the top surface 123 of the polishing layer 122 is ground by the slurry 132 and the wafer 210 (see FIG. 1), the thickness of the polishing layer 122 is worn down, such that the first groove 124 may be worn down and the second groove 126 may be exposed through the top surface 123 of the polishing layer 122. Therefore, even if the first groove 124 is worn down, the second groove 126 is opened to continuously accommodate the slurry 132. That is to say, after the first groove 124 is worn down because of the top surface 123 of the polishing layer 122 being ground by the slurry 132 and the wafer 210 (see FIG. 1), the slurry 132 dispensed onto the top surface 123 of the polishing layer 122 may also flow into the second groove 126.

As shown in FIG. 1 and FIG. 4, since the second groove 126 may be exposed to accommodate the slurry 132 when the first groove 124 is worn down, the slurry 132 may be accommodated in both of the residual first groove 124 and the opened second groove 126. As a result of such a design, the first groove 124 and the second groove 126 of the polishing layer 122 may be designed with decreased depths. Since a polish pad having a deep groove generally needs a greater flow rate of polishing slurry than a polish pad having a shallow groove to produce a similar polishing rate. Thus, as the first groove 124 and the second groove 126 of the polishing layer 122 are reduced, the flow rate of the slurry 132 may also be reduced, yet the polishing rate may be maintained. In other words, the usage amount of the slurry 132 may be reduced.

Furthermore, due to the polishing layer 122 has the first and second grooves 124, 126 to accommodate the slurry 132, the number of wafers polished by the polishing layer 122 accommodating the slurry 132 is increased. Therefore, the life time of the polishing pad 120 may be extended. Accordingly, when the polishing layer 122 of the polishing pad 120 having the first and second grooves 124, 126 is used in the chemical-mechanical polishing apparatus 100, the number of preventive maintenances (PM) for the polishing pad 120 during a period of time may be decreased, so that the operation time of the chemical-mechanical polishing apparatus 100 may be extended.

Moreover, if the wafer 210 is usually polished on an edge portion of the polishing layer 122, such as the position of the wafer 210 shown in FIG. 1, the second groove 126 may be formed in the edge portion of the polishing layer 122 corresponding to the position of the wafer 210. Since the portion of the polishing layer 122 where the wafer 210 is on is ground faster than the other portion of the polishing layer 122, the position of the second groove 126 in the polishing layer 122 may be decided depending on the relative position of the wafer 210 and the polishing layer 122.

As shown in FIG. 3, in some embodiments, the first and second grooves 124, 126 are alternatively arranged in the polishing layer 122, and the orthogonal projection of the first groove 124 on the first support layer 128 does not overlap the orthogonal projection of the second groove 126 on the first support layer 128. In other words, the central line L1 of the first groove 124 and the central line L2 of the second groove 126 are parallel and spaced apart at a distance d1. Such configuration may ensure that the second groove 126 is exposed through the top surface 123 of the polishing layer 122 after the first groove 124 is substantially worn out.

In some embodiments, the top surface 123 of the polishing layer 122 has a plurality of first grooves 124 therein and the bottom surface 125 of the polishing layer 122 has a plurality of second grooves 126 therein. The orthogonal projection of each of the second grooves 126 on the top surface 123 is between two adjacent first grooves 124.

The polishing pad 120 may further include a second support layer 129, and the first support layer 128 is located between the second support layer 129 and the polishing layer 122. In some embodiments, the hardness of the second support layer 129 is greater than the hardness of the first support layer 128, and the hardness of the first support layer 128 is greater than the hardness of the polishing layer 122, but various embodiments of the present disclosure are not limited in this regard. As a result of such a design, the second support layer 129 is used to support the first support layer 128 and the polishing layer 122.

Figure 5:
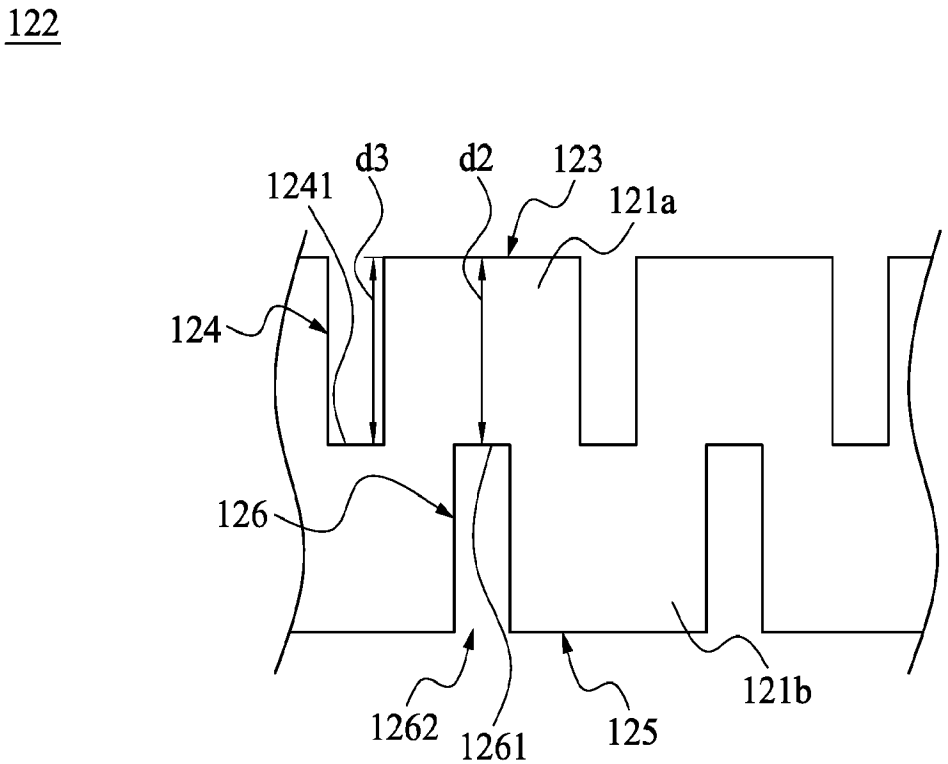
FIG. 5 is a partially enlarged view of a polishing layer shown in FIG. 3.

FIG. 5 is a partially enlarged view of the polishing layer 122 shown in FIG. 3. As shown in FIG. 3 and FIG. 5, the first groove 124 of the polishing layer 122 has a bottom portion 1241, and the second groove 126 of the polishing layer 122 has a bottom portion 1261. In some embodiments, the bottom portion 1241 of the first groove 124 and the bottom portion 1261 of the second groove 126 are at the same horizontal level. As a result of such a design, after the first groove 124 is worn down and may have disappeared, the second groove 126 may be exposed through the top surface 123 continuously.

In some embodiments, a perpendicular distance d2 between the bottom portion 1261 of the second groove 126 and the top surface 123 may be smaller than or equal to a perpendicular distance d3 between the bottom portion 1241 of the first groove 124 and the top surface 123. If the perpendicular distance d2 between the bottom portion 1261 and the top surface 123 is smaller than the perpendicular distance d3 between the bottom portion 1241 and the top surface 123, the polishing layer 122 having such first and second grooves 124, 126 may ensure that the second groove 126 is exposed through the top surface 123 before the first groove 124 is worn out. If the perpendicular distance d2 between the bottom portion 1261 and the top surface 123 is equal to the perpendicular distance d3 between the bottom portion 1241 and the top surface 123, such polishing layer 122 may ensure that the first groove 124 is worn out and the second groove 126 is exposed through the top surface 123 simultaneously.

In some embodiments, the polishing layer 122 has at least one first protruding portion 121*a* and at least one second protruding portion 121*b*. The first protruding portion 121*a* may be referred to as a solid portion that separates at least two of the first grooves 124, and the second groove 126 is buried at least beneath the first protruding portion 121*a* of the polishing layer 121*a*. The first protruding portion 121*a* is adjacent to the first groove 124, and the second protruding portion 121*b* is adjacent to the second groove 126. Moreover, the first groove 124 may be aligned with the second protruding portion 121*b*, and the second groove 126 may be aligned with the first protruding portion 121*a*. As a result, the first and second grooves 124, 126 are alternatively arranged in the polishing layer 122. After the first protruding portion 121*a* is ground by the slurry 132 (see FIG. 1) and a number of wafers 210 (see FIG. 1) for a period of time, the second groove 126 may be exposed and opened to accommodate the slurry 132 on the polishing layer 122 even if the first groove 124 is gradually worn out to accommodate less and less slurry 132, such that the polishing layer 122 of the polishing pad 120 may still retain a sufficient amount of the slurry 132 to polish the wafer 210.

Figure 6:
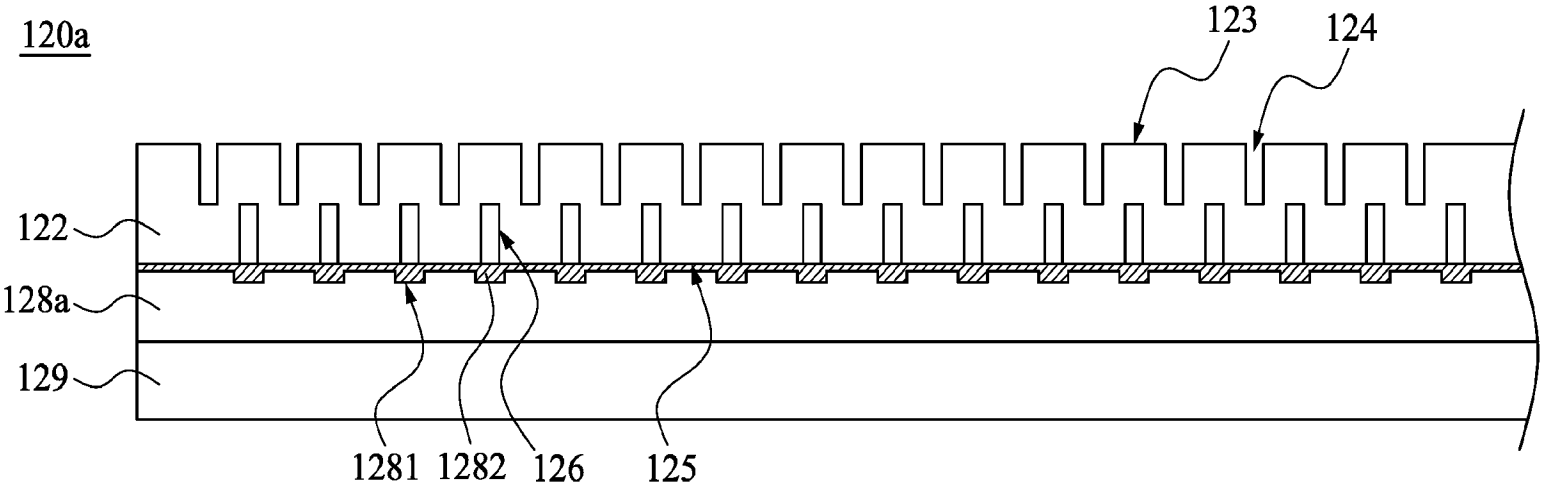
FIG. 6 is a cross-sectional view of a polishing pad according to some embodiments of the present disclosure.

FIG. 6 is a cross-sectional view of a polishing pad 120*a* according to some embodiments of the present disclosure. As shown in FIG. 6, the first support layer 128*a* may further have a recess 1281 therein. The recess 1281 of the first support layer 128*a* is in communication with the second groove 126 and is substantially aligned with the second groove 126.

The polishing pad 120*a* may further include an adhesive 1282. The adhesive 1282 is present at least between the first support layer 128*a* and the polishing layer 122, and at least a portion of the adhesive 1282 is present in the recess 1281. During assembling the polishing layer 122 and the first support layer 128*a*, the adhesive 1282 may be coated on a surface of the first support layer 128*a* having the recess 1281. Thereafter, the polishing layer 122 may be adhered to the surface of the first support layer 128*a*. Since the first support layer 128*a* has the recess 1281 therein, the excess adhesive 1282 may flow into the recess 1281. As a result of such a design, the recess 1281 in the first support layer 128*a* may prevent the excess adhesive 1282 from flowing into the second groove 126 of the polishing layer 122, such that space in the second groove 126 is not occupied by the adhesive 1282. In other words, the recess 1281 of the first support layer 128*a* may ensure that the space of the second groove 126 is used to accommodate the slurry.

Figure 7:
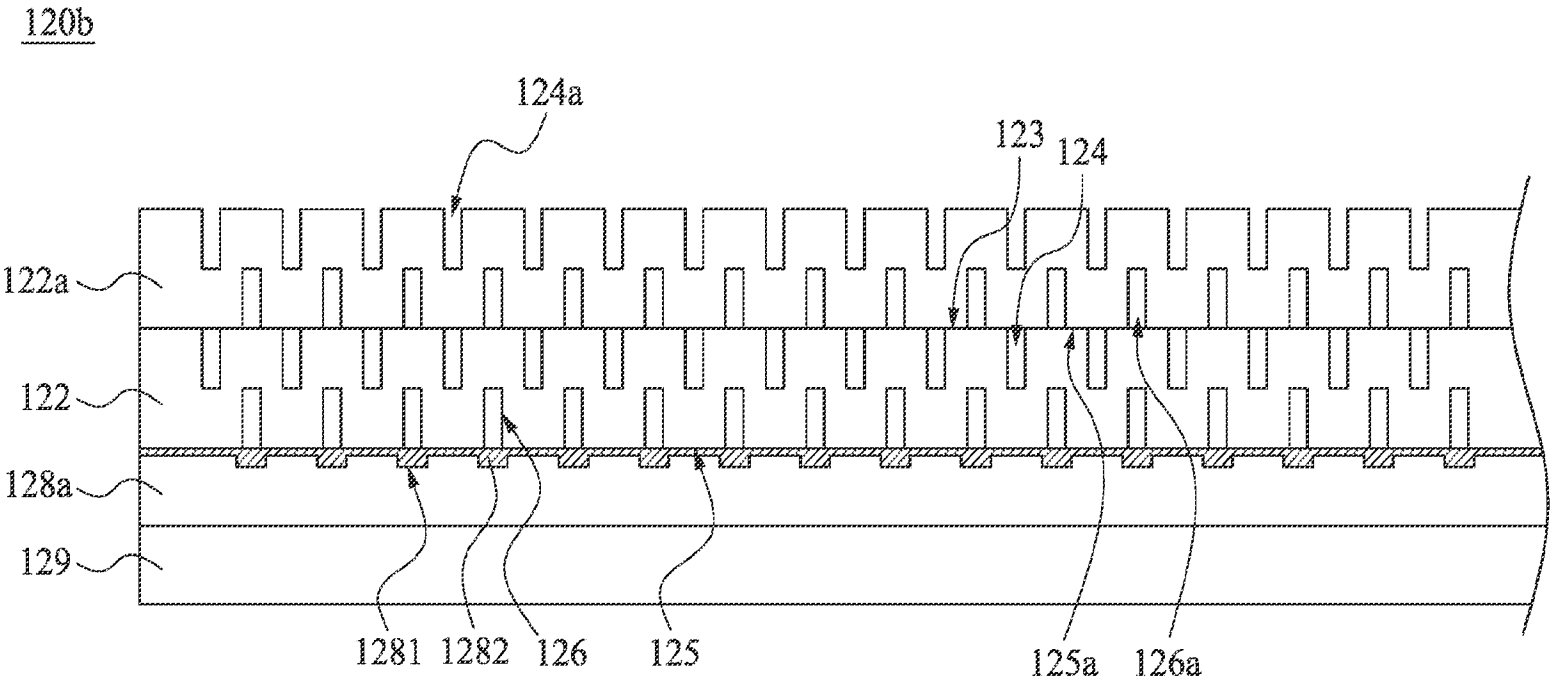
FIG. 7 is a cross-sectional view of a polishing pad according to some embodiments of the present disclosure.

FIG. 7 is a cross-sectional view of a polishing pad 120*b* according to some embodiments of the present disclosure. As shown in FIG. 7, the polishing pad 120*b* may further include another polishing layer 122*a*. The structure of the polishing layer 122*a* may be substantially the same as the structure of the polishing layer 122, and the polishing layer 122*a* is stacked on the polishing layer 122, such that the bottom surface 125*a* of the polishing layer 122*a* is in contact with the top surface 123 of the polishing layer 122. In addition, the polishing layers 122, 122*a* may be made of a material including polyurethane, but various embodiments of the present disclosure are not limited in this regard.

In some embodiments, the first groove 124*a* of the polishing layer 122*a* may be aligned with the first groove 124 of the polishing layer 122, and the second groove 126*a* of the polishing layer 122*a* may be aligned with the second groove 126 of the polishing layer 122.

When the polishing pad 120*b* is used in a chemical-mechanical polishing apparatus, due to the polishing pad 120*b* has four layers of grooves including the first groove 124*a*, the second groove 126*a*, the third groove 124, and the fourth groove 126 respectively at different horizontal levels, such configuration may extend the life time of the polishing pad 120*b*, and may decrease the number of preventive maintenances (PM) for the polishing pad 120*b*.

Figure 8:
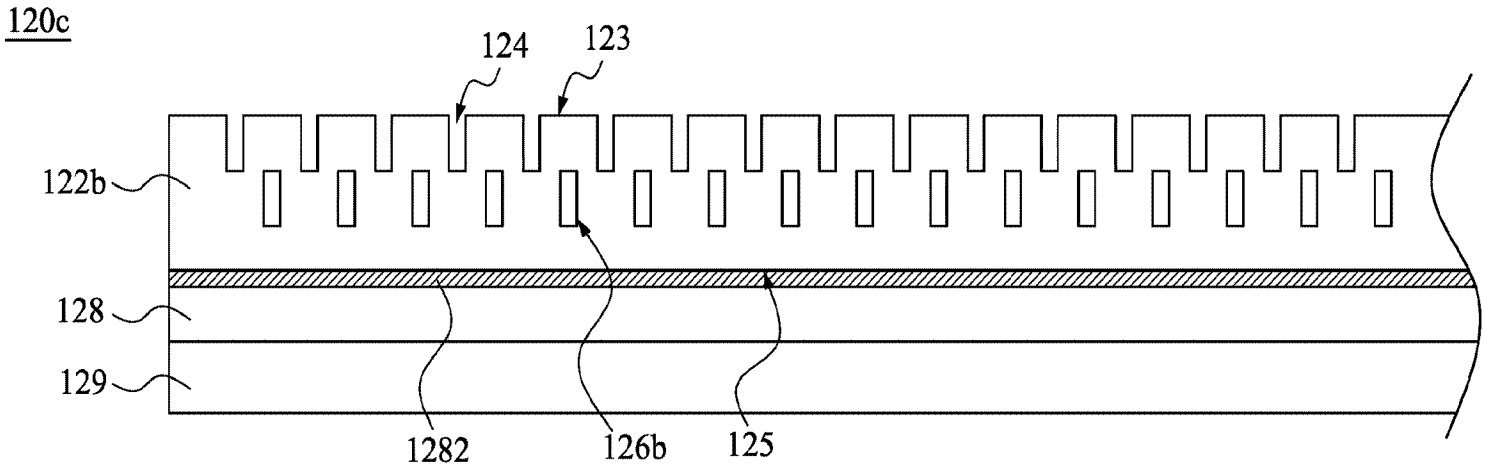
FIG. 8 is a cross-sectional view of a polishing pad according to some embodiments of the present disclosure.

FIG. 8 is a cross-sectional view of a polishing pad 120*c* according to some embodiments of the present disclosure. The second groove 126*b* is not only buried beneath the top surface 123 of the polishing layer 122*b*, but also buried beneath the bottom surface 125 of the polishing layer 122*b*. When the first groove 124 is worn out, the second groove 126*b* may be exposed through the top surface 123 to continuously accommodate the slurry 132 (see FIG. 1). Moreover, in some embodiments, the adhesive 1282 is located between the polishing layer 122*b* and the first support layer 128. Since the second groove 126*b* is an enclosed cavity before the first groove 124 is worn out, the adhesive 1282 under the bottom surface 125 of the polishing layer 122*b* does not flow into the second groove 126*b* when the polishing layer 122*b* is adhered to the first support layer 128. Such configuration may ensure that the space of the second groove 126*b* is not occupied by the adhesive 1282.

Figure 9:
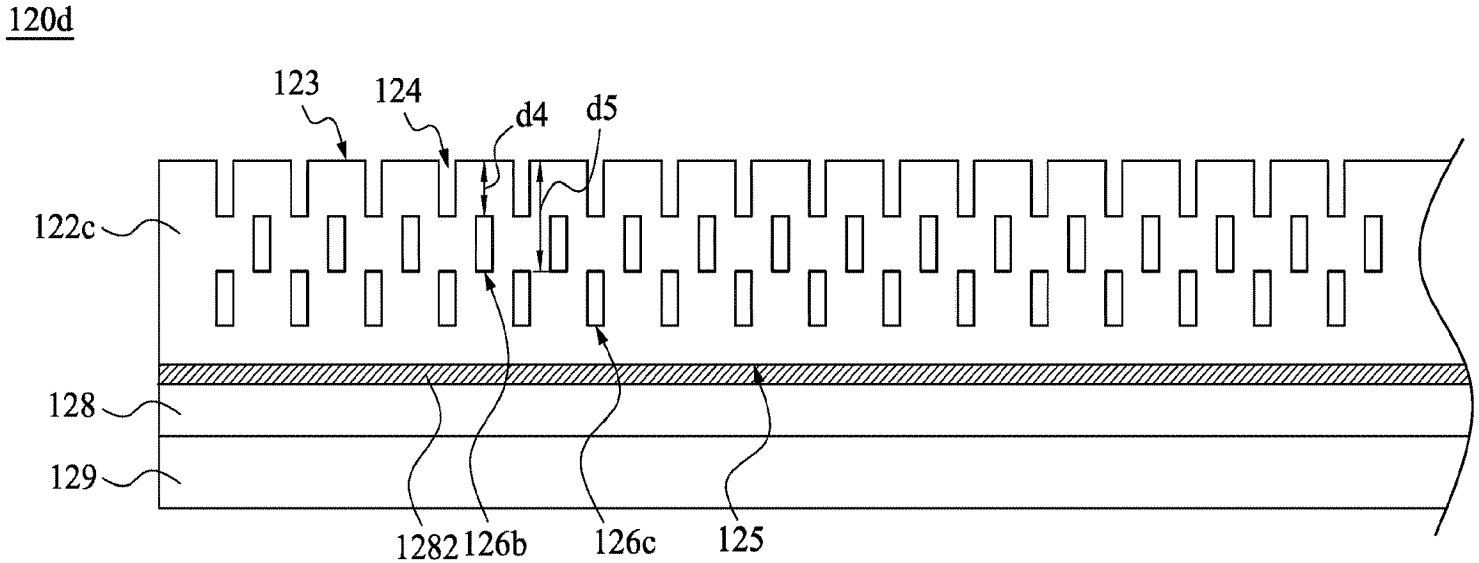
FIG. 9 is a cross-sectional view of a polishing pad according to some embodiments of the present disclosure.

FIG. 9 is a cross-sectional view of a polishing pad 120*e* according to some embodiments of the present disclosure. As shown in FIG. 9, the polishing layer 122*c* further has at least one third groove 126*c* that is buried at least beneath the top surface 123 of the polishing layer 122*c*. The second groove 126*b* is separated from the top surface 123 of the polishing layer 122*c* at a first vertical distance d4, and the third groove 126*c* is separated from the top surface 123 of the polishing layer 122*c* at a second vertical distance d5, and the first vertical distance d4 and the second vertical distance d5 are different. In some embodiments, the first vertical distance d4 is smaller than the second vertical distance d5.

When the polishing pad 120*d* is used in a chemical-mechanical polishing apparatus, due to the polishing pad 120*d* has three layers of grooves including the first groove 124, the second groove 126*b*, and the third groove 126*c* respectively at different horizontal levels, thereby extending the life time of the polishing pad 120*d* and decreasing the number of preventive maintenances (PM) for the polishing pad 120*d*.

Figure 10:
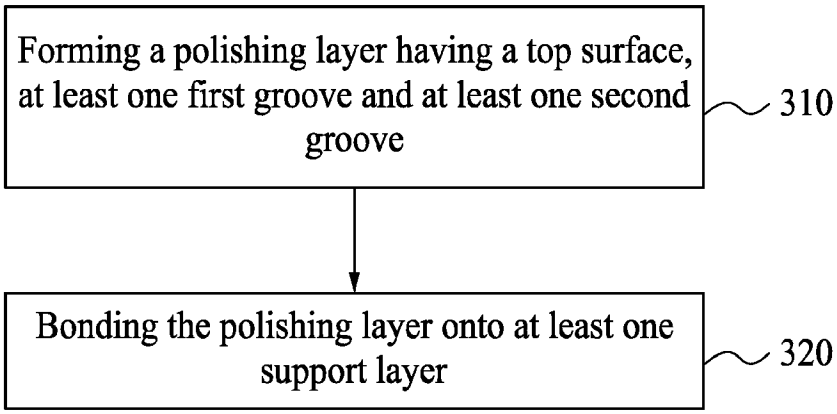
FIG. 10 is a flow chart of a method for manufacturing a polishing pad according to some embodiments of the present disclosure.

FIG. 10 is a flow chart of a method for manufacturing a polishing pad according to some embodiments of the present disclosure. The method begins with block 310 in which a polishing layer having a top surface, at least one first groove and at least one second groove is formed. The first groove and the second groove are separated from the top surface of the polishing layer at different vertical distances. The method continues with block 320 in which, the polishing layer is bonded onto at least one support layer. The top surface of the polishing layer faces away from the support layer after the bonding.

In some embodiments, the polishing layer of the polishing pad may be formed by three-dimensional (3D) printing. For example, the polishing layer may be formed by selective laser sintering (SLS) of 3D printing. In some embodiments, a 3D printer may utilize polyurethane to manufacture the polishing pad that includes the polishing layer. The method of selective laser sintering may form the first and second grooves respectively in the top surface and the bottom surface of the polishing layer. In addition, the precision of the polishing pad may be in a range about 0.2 mm to 1.2 mm and the precision of selective laser sintering may be smaller than about 0.07 mm, so that the method of selective laser sintering may comply with the precision of the polishing pad.

Alternatively, the first groove may be formed by machining the top surface of the polishing layer, and the second groove may be formed by machining the bottom surface of the polishing layer. "Machining" used herein means that any of various processes in which a piece of raw material is cut into a desired final shape and size by a controlled material-removal process.

In some embodiments, the polishing pad may be formed by maturing. The forming the polishing layer may include the following steps. A first layer of the polishing layer is formed. Thereafter, a first mask is disposed on the first layer of the polishing layer. Afterwards, the first layer of the polishing layer is matured after the disposing the first mask. Next, the first mask is moved from the first layer of the polishing layer to create at least one groove space in the first layer of the polishing layer. Subsequently, a second layer of the polishing layer is formed on the first layer of the polishing layer, and the groove space is buried beneath the second layer of the polishing layer to be the first groove. The first and second layers may be made of material including polyurethane, but various embodiments of the present disclosure are not limited in this regard, other materials (e.g., rubber) may be also used to form the polishing pad through maturing.

Moreover, the forming the polishing layer may further include the following steps. A second mask is disposed on the second layer of the polishing layer. Thereafter, the second layer of the polishing layer is matured after the disposing the second mask. Subsequently, the second mask is removed from the second layer of the polishing layer to create the second groove in the second layer of the polishing layer. In the following description, a polishing method will be described.

Figure 11:
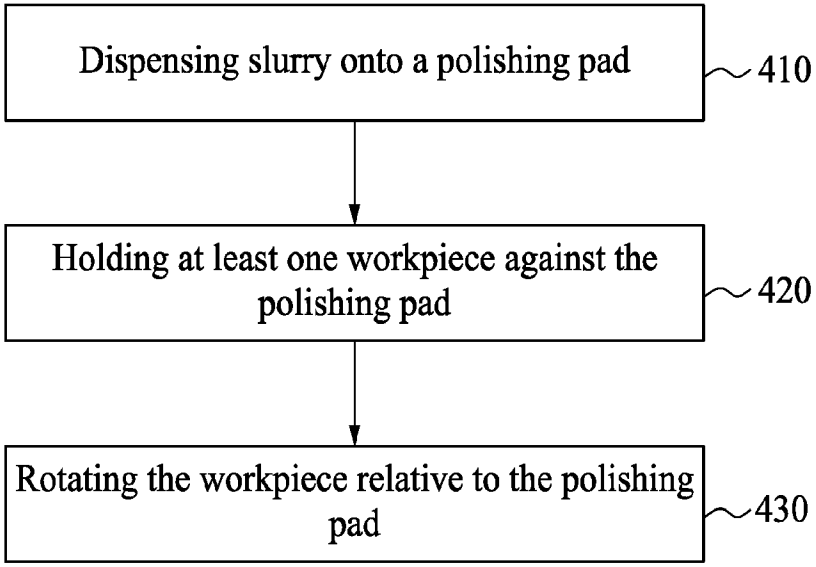
FIG. 11 is a flow chart of a polishing method according to some embodiments of the present disclosure.

FIG. 11 is a flow chart of a polishing method according to some embodiments of the present disclosure. The method begins with block 410 in which slurry is dispensed onto a polishing pad. The polishing pad has at least one open groove and at least one buried groove, and the dispensing the slurry dispenses at least a portion of the slurry into the open groove. The method continues with block 420 in which at least one workpiece (e.g., a silicon wafer) is held against the polishing pad. The method continues with block 430 in which the workpiece is rotated relative to the polishing pad. The polishing pad is worn to expose the buried groove during the rotating.

In some embodiments, the dispensing the slurry further includes dispensing at least another portion of the slurry into the exposed buried groove.

In order to maintain a specific quantity of slurry on a polishing pad and extend the life time of the polishing pad, a polishing pad for a chemical-mechanical polishing apparatus, a method for manufacturing the polishing pad, and a polishing method are designed to accommodate the slurry in the first groove and/or the second groove that are respectively at two opposite sides of the polishing layer. When the slurry is dispensed onto the polishing layer of the polishing pad, the first groove in the top surface of the polishing layer may accommodate the slurry. After the top surface of the polishing layer is ground by a number of wafers for a period of time, the first groove may be worn out and disappeared. However, at this moment, the second groove in the bottom surface of the polishing layer may be exposed through the top surface to continuously accommodate the slurry. As a result, the planarization and the yield rate of the wafer may be improved, and the usage amount of the slurry may be reduced, and the life time of the polishing pad may be extended. Furthermore, the number of preventive maintenances (PM) for the polishing pad during a period of time may be decreased, so that the operation time of the chemical-mechanical polishing apparatus may be extended.

In accordance with some embodiments of the present disclosure, a polishing pad for a chemical-mechanical polishing apparatus includes a first support layer and a polishing layer. The polishing layer is present on the first support layer. The polishing layer has a top surface that faces away from the first support layer and at least one first cavity that is buried at least beneath the top surface of the polishing layer.

In accordance with some embodiments of the present disclosure, a method for manufacturing a polishing pad includes forming a polishing layer having a top surface, at least one first groove and at least one second groove, in which the first groove and the second groove are separated from the top surface of the polishing layer at different vertical distances. The polishing layer is bonded onto at least one support layer, in which the top surface of the polishing layer faces away from the support layer after the bonding.

In accordance with some embodiments of the present disclosure, a polishing method includes dispensing slurry onto a polishing pad, in which the polishing pad has at least one open groove and at least one buried groove, and the dispensing the slurry dispenses at least a portion of the slurry into the open groove. At least one workpiece is held against the polishing pad. The workpiece is rotated relative to the polishing pad, in which the polishing pad is worn to expose the buried groove during the rotating.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for manufacturing a polishing pad for attachment to a platen, comprising:

forming a polishing layer having a top surface, wherein the forming the polishing layer comprises defining a first cavity; and bonding the polishing layer onto a support layer defining a recess such that the first cavity overlies the recess, wherein the top surface of the polishing layer faces away from the support layer after the bonding and the first cavity is buried beneath the top surface of the polishing layer after the bonding and upon the polishing pad being attached to the platen, the platen is closer to the support layer than to the polishing layer.

2. The method of claim 1, wherein the forming the polishing layer comprises forming the polishing layer by three-dimensional printing.

3. The method of claim 1, wherein the forming the polishing layer comprises forming the polishing layer by selective laser sintering.

4. The method of claim 1, wherein the forming the polishing layer comprises using a sintering process to form the first cavity in the polishing layer.

5. The method of claim 1, wherein the forming the polishing layer comprises performing a machining process on a bottom surface of the polishing layer to form the first cavity in the polishing layer.

6. The method of claim 1, wherein the forming the polishing layer comprises:

forming a first layer of the polishing layer;

disposing a first mask on the first layer of the polishing layer;

maturing the first layer of the polishing layer after the disposing the first mask;

removing the first mask from the first layer of the polishing layer to define the first cavity in the first layer of the polishing layer; and forming a second layer of the polishing layer on the first layer of the polishing layer and burying the first cavity beneath the second layer of the polishing layer.

7. The method of claim 6, wherein at least one of the first layer or the second layer comprises polyurethane.

8. The method of claim 6, wherein the forming the polishing layer comprises:

disposing a second mask on the second layer of the polishing layer;

maturing the second layer of the polishing layer after the disposing the second mask; and removing the second mask from the second layer of the polishing layer to define a second cavity in the second layer of the polishing layer.

9. The method of claim 1, wherein the forming the polishing layer comprises defining a first groove in the top surface of the polishing layer.

10. The method of claim 1, wherein the bonding comprises:

applying an adhesive over the support layer; and adhering the polishing layer to the support layer using the adhesive.

11. The method of claim 10, wherein the applying the adhesive comprises applying the adhesive in the recess.

12. A method for manufacturing a polishing pad, comprising:

forming a polishing layer having a top surface and a bottom surface, wherein the forming the polishing layer comprises defining a plurality of first cavities disposed between the top surface of the polishing layer and the bottom surface of the polishing layer such that two adjacent cavities of the plurality of first cavities have a uniform height measured between the top surface of the polishing layer and the bottom surface of the polishing layer and such that a solid portion is disposed between the top surface of the polishing layer and a cavity of the plurality of first cavities;

forming a second polishing layer over the polishing layer, wherein a second cavity is defined by the second polishing layer; and bonding the polishing layer onto a support layer, wherein the top surface of the polishing layer faces away from the support layer.

13. The method of claim 12, comprising attaching a second support layer to a bottom surface of the support layer, wherein a hardness of the second support layer is greater than a hardness of the support layer.

14. The method of claim 12, wherein each of the plurality of first cavities extends from the bottom surface of the polishing layer through a portion of the polishing layer.

15. The method of claim 12, wherein the forming the polishing layer comprises defining an open cavity on the top surface of the polishing layer.

16. The method of claim 12, wherein the forming the polishing layer comprises forming the polishing layer by three-dimensional printing.

17. The method of claim 12, wherein the forming the polishing layer comprises:

forming a first layer of the polishing layer;

disposing a first mask on the first layer of the polishing layer;

maturing the first layer of the polishing layer after the disposing the first mask;

removing the first mask from the first layer of the polishing layer to define the plurality of first cavities in the first layer of the polishing layer; and forming a second layer of the polishing layer on the first layer of the polishing layer and burying the plurality of first cavities beneath the second layer of the polishing layer.

18. A method for manufacturing a polishing pad, comprising:

forming a polishing layer having a top surface, wherein the forming the polishing layer comprises defining a first row of cavities and a second row of cavities; and bonding the polishing layer onto a support layer defining one or more recesses such that at least some cavities in the first row of cavities overlie at least some recesses of the one or more recesses, wherein the top surface of the polishing layer faces away from the support layer after the bonding and the first row of cavities and the second row of cavities are buried beneath the top surface of the polishing layer after the bonding and upon the polishing pad being attached to a platen, the platen is closer to the support layer than to the polishing layer.

19. The method of claim 18, wherein the forming the polishing layer comprises defining a row of grooves in the top surface of the polishing layer.

20. The method of claim 19, wherein:

the second row of cavities is between the first row of cavities and the row of grooves, and the second row of cavities is offset from at least one of the first row of cavities or the row of grooves in a direction perpendicular to the top surface of the polishing layer.

* * * * *